United States Patent [19]

Angheluta et al.

[11] Patent Number: 5,029,345

[45] Date of Patent: Jul. 9, 1991

[54] MAN'S UNDERWEAR WITH AN INTEGRAL CODPIECE-LIKE CONSTRUCTION

[76] Inventors: Alexandru Angheluta, 5030 N. Marine Dr., Chicago, Ill. 60640; Leonard I. Kranzler, 1212 N. Lake Shore Dr., Chicago, Ill. 60610

[21] Appl. No.: 477,475

[22] Filed: Feb. 9, 1990

[51] Int. Cl.[5] ..... A41B 9/02

[52] U.S. Cl. ..... 2/403; 2/405; 128/159

[58] Field of Search ..... 2/79, 227, 402, 403, 2/404, 405; 128/159

[56] References Cited

U.S. PATENT DOCUMENTS

| | | | |
|---|---|---|---|
| 898,258 | 9/1908 | Peters | 128/159 |
| 1,263,576 | 4/1918 | Linneros | 128/159 |
| 1,987,369 | 1/1935 | O'Shea | 128/159 |
| 2,012,879 | 8/1935 | Kneibler | 128/159 |
| 2,033,551 | 3/1936 | Rummery . | |
| 2,235,849 | 3/1941 | Reis | 128/159 |
| 2,457,260 | 12/1948 | Morris | 128/159 |
| 2,601,602 | 6/1952 | Firsching, Sr. | 128/159 |
| 2,624,336 | 1/1953 | Hensley | 128/159 |
| 2,664,889 | 1/1954 | Bailey | 2/403 X |
| 3,220,410 | 11/1965 | Sloan . | |
| 3,283,545 | 11/1966 | Simon . | |
| 3,314,422 | 4/1967 | Phillips . , | |
| 3,441,022 | 4/1969 | Severson et al. . | |
| 3,487,833 | 7/1967 | Senser | 2/405 X |
| 3,491,375 | 1/1990 | Beard et al. . | |
| 3,496,576 | 2/1970 | Artzt . | |
| 3,517,666 | 6/1970 | Atlee . | |
| 3,706,103 | 12/1972 | Senser . | |
| 3,844,282 | 10/1974 | King . | |
| 4,195,630 | 4/1980 | Connery | 128/159 |
| 4,326,302 | 4/1982 | Lowe et al. . | |
| 4,345,337 | 8/1982 | Chung . | |
| 4,377,008 | 3/1983 | Jung | 2/403 |
| 4,414,971 | 11/1983 | Chung . | |
| 4,759,355 | 7/1988 | Thrower | 2/405 X |
| 4,961,419 | 10/1990 | Tribble et al. | 128/159 |

FOREIGN PATENT DOCUMENTS

| | | | |
|---|---|---|---|
| 105649 | 11/1938 | Australia | 128/159 |
| 454758 | 3/1949 | Canada | 2/405 |
| 1017450 | 12/1952 | France | 2/405 |
| 1537902 | 7/1968 | France | 128/159 |
| 2258805 | 8/1975 | France | 2/405 |
| 442607 | 11/1948 | Italy | 128/159 |
| 76166 | 1/1950 | Italy | 2/405 |
| 459968 | 1/1937 | United Kingdom | 2/405 |
| 529742 | 11/1940 | United Kingdom | 2/405 |
| 666434 | 2/1952 | United Kingdom | 2/404 |

*Primary Examiner*—Werner H. Schroeder
*Assistant Examiner*—Jeanette E. Chapman
*Attorney, Agent, or Firm*—Hill, Van Santen, Steadman & Simpson

[57] ABSTRACT

A man's garment, particularly a man's underwear garment, providing a codpiece compartment secured to a front of a trunk panel of the garment, the trunk panel providing an opening for communicating a man's genitals therethrough into the codpiece compartment, the compartment loosely holding the man's genitals, the trunk panel providing separation and heat insulation to reduce the thermal influence of the man's torso on the man's reproductive organs, to safeguard the potency of the man's sperm. The undergarment provides an access out of the codpiece compartment for removing the man's penis in order to urinate. The invention provides for an easily assembled undergarment with an attractive uncluttered appearance.

19 Claims, 1 Drawing Sheet

MAN'S UNDERWEAR WITH AN INTEGRAL CODPIECE-LIKE CONSTRUCTION

BACKGROUND OF THE INVENTION

One very popular, comfortable, and well-known style of a man's underwear shorts, or brief, known in the prior art, provides a snug fitting garment that is usually woven of cotton, or similar material, and which cotton garment is constructed and arranged to provide stretchable, band-like sections, for encircling, and resiliently engaging, waist and upper leg portions of a wearer's lower torso, with the garment being further shaped so as to provide a pocket-shaped, or bulged, section defined by the garment, that is adapted to snugly engage, or hug the wearer's body, defined forwardly of the crotch of the garment adapted to receive the male's genitals and to hold same against the body of the person wearing such underwear shorts. Said pocket, or bulge-shaped garment section, usually includes a pair of abutting, and selectively separable, panel sections that together cooperate to provide a selectively, manually-openable, front-opening fly, that affords, in a well-known manner, manual access to the wearer's penis, for effecting selective manual movement of the penis, forwardly and outwardly of the undergarment, as is required to urinate.

An inventor, one Seun Y. Chung, of the Rep. of Korea, in his U.S. Pat. No. 4,345,337 dated Aug. 24, 1982, disclosed a construction wherein a wearer of a brief-type underpants is encouraged to use structures that will deliberately space the user's penis and seminal vesicle both from each other and from adjacent body parts. However, the structure as described in said U.S. Patent can be dangerous to the user, and appears to encourage or stimulate a risk of injury, in that U.S. Pat. No. 4,345,337 discloses use of a structure of a band-type ring, upon which a user is encouraged to, unnaturally, hang his penis, so that (a) the penis and scrotum will be, unnaturally, separated from each other and from the wearer's body, and (b) with a suggestion by the inventor, to provide use of a "coarse rubbing cloth" to rub the penis to dull the senses of the penis, a practice that Applicants herein submit to be unnatural, possibly dangerous and hence undesirable, because of a danger of injury: (a) from deliberately dulling the ability of the penis to sense naturally, or (b) by putting the penis at a position of risk of injury in the event of an unforeseeable relative movement between the ring and penis that puts that male organ at risk of injury from inadvertent, or unintended movement between the ring and penis, or between the penis and the scrotum.

The instant invention relates to a new and improved form of construction of a man's underwear garment, known as underwear shorts, which improved form of shorts provides advantages over prior art constructions as will be described hereinafter, while avoiding the physical dangers and risks that could stem from use of a prior art construction of the type that is referred to hereinabove.

It has been known, or at least an established belief, based upon observations, that the heat of a man's body, when communicated directly and continuously, to the sperm in his testes, may, or could, adversely affect the virility of the man's sperm, and may produce a condition of reduced potency of the sperm, resulting in apparent sterility, or inability to fertilize a female ovum.

A known commercialized style of a man's underwear shorts sold under the popular Registered Mark "Jockey", is known to be constructed to provide underwear shorts formed of woven, cotton-like material or its equivalent, and being constructed to provide one or more of the following features: an elastic waistband for the garment, and stretchable, or elastic bands, or other body-encircling parts, secured to lower edge portions of an underwear garment that surrounds leg openings defined for the garment. It has also been known in the prior art, to provide an expandable, or stretchable knit pocket, such as is similar to and generally shown and described in prior art U.S. Pat. No. 3,283,545 issued Nov. 8, 1966 to E. Simon.

The instant invention relates to a new, and improved, underwear shorts garment for men. More particularly, this invention relates to a man's underwear shorts construction that is constructed and arranged in a novel manner, namely with an integral codpiece type structure, so that when the improved underwear shorts are worn, the male's scrotum can be desirably spaced from the lower trunk of the wearer's body, held inside the codpiece type structure in a loose fitting manner, and thereby insulating the scrotum, by structure provided and included in the underwear shorts, from the body temperature and heat of adjacent body parts, so that the virility of the male's sperm will be maintained at its optimum level.

The definition of the term "codpiece", which will be used herein, may be found in a *Webster's Third New International Dictionary* copyright 1986, p 438 as: "an often ornamental flap or bag concealing an opening in the front of men's breeches esp. in the 15th and 16th centuries". It is now the 20th century, and a codpiece appears to be a concept from a long distant past, established by the definition quoted above, and it is not presently, an apt description of any structure, or concept, presently known to be in use with respect to modern men's shorts or briefs having the features described herein.

SUMMARY OF THE INVENTION

It is an object of the present invention to provide a underwear garment, particularly a man's shorts which provides:

- a codpiece structure to hold and support a male's genitals away from his body;
- a codpiece structure which acts to insulate the male's genitals from the heat of the adjacent body portions;
- a codpiece structure which holds the male's genitals without compressing the genitals against the male's trunk;
- a codpiece structure providing a convenient opening for the male wearer to remove his penis in order to urinate;
- a simple fabric structure of the man's shorts, easily and cost effectively fabricated;
- a man's underwear shorts comfortable for the wearer;
- a man's underwear shorts of durable and long lasting construction;
- a codpiece structure constructed to provide for absorbency of accidental urine; and
- a man's underwear shorts having a neat and uncluttered appearance.

The objects are inventively achieved in that a man's underwear shorts are disclosed which:

provides on a fabric panel, adjacent to the male's trunk or lower torso, an opening which communicates into a codpiece compartment, providing a comfortable access into the codpiece enclosure for the male's genitals, and acts to hold and support a male's genitals away from his body;

provides a fabric panel which insulates the wearer's genitals from heat generated by the wearer's lower torso;

provides between the codpiece enclosure and the fabric panel of the man's shorts a side access for removal of the man's penis to urinate when desired;

provides a codpiece compartment which loosely holds the male's genitals to prevent compressing the male's genitals against the male's trunk;

comprises a minimum of panels to be sewn together to construct the shorts;

provides a codpiece structure comprised of only three panels sewn together to form a compartment;

provides elastic bands or sleeves to comfortably encircle the wearer's legs and trunk to securely fit the man's shorts to the wearer;

provides as an alternative construction the front panel of the codpiece enclosure with a double thickness of material for absorbency;

provides a codpiece which covers the front of the man's shorts in a neat and uncluttered appearance.

DESCRIPTION OF THE PREFERRED EMBODIMENTS

Figure 1:
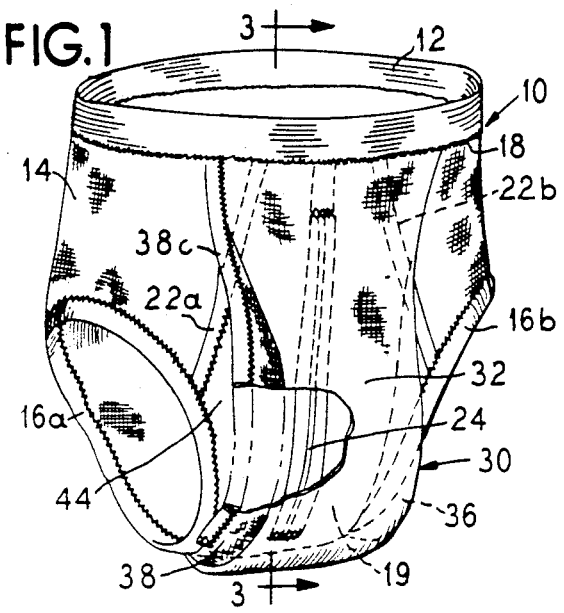
FIG. 1 is a partially fragmentary front perspective view of a man's underwear shorts, portions shown broken away to illustrate body-engaging portions of the shorts and of a codpiece like enclosure.

FIGS. 1–6 illustrates one form of a man's garment or underwear shorts 10 that embodies the invention disclosed herein. Although in the preferred embodiment the invention relates particularly to underwear shorts, the spirit and scope of the invention is also applicable to other garments. The invention could just as readily be applied to "long johns" or "long underwear", or even bathing wear or pajamas. Such garments and any other appropriate garments are encompassed by the present invention.

The man's underwear shorts 10 shown in FIGS. 1–4, includes some elements and features that are known in the prior art, and also some new elements. Generally, the waist and back side of the shorts 10 are known in the prior art. What is new is located principally at the front of the garment.

Referring now to the drawings, each of FIGS. 1–6 show certain elements of a new, useful, and not-obvious construction of a man's underwear garment. The garment 10 includes a stretchable, continuous, elastic waist band 12 at the upper end thereof. The garment 10 includes a generally frustroconical, back-and-side-encircling, fabric panel 14, which secures at its upper end to the waist band 12, with the fabric panel 14 extending downwardly from the waist band 12 to attach to two leg-surrounding, resilient, leg-gripping bands, or welts 16*a* and 16*b*. Said leg-gripping bands, or welts comprise any desired construction that will function to help hold the fabric panel 14 in its desired attitude, and position, as illustrated in the Figures of this Application. The waist band 12 is secured to the fabric panel 14 by a waist seam 18, which encircles the shorts 10. A trunk panel 19 is secured to the waist band 12 at the waist seam 18 and secured to the fabric panel 14 at three seams: a bottom seam 20, a first lateral seam 22*a*, and a second lateral seam 22*b*. A slot 24 is provided through the trunk panel 19.

Figure 3:
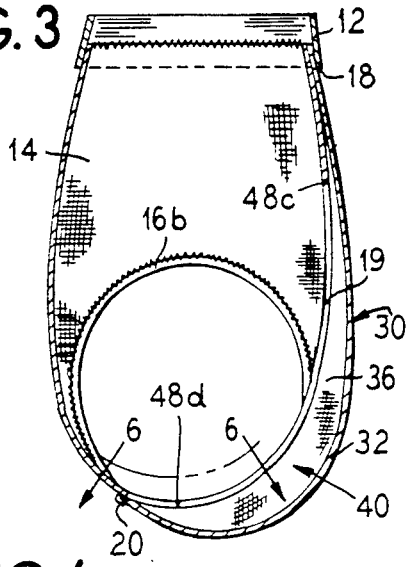
FIG. 3 is a cross-sectional view of the man's shorts viewed generally along line 3—3 of FIG. 1.

A codpiece for the garment that has been thus far described is shown in perspective in FIG. 1 and in cross-sectional view in FIG. 3. The codpiece is labeled 30 in FIG. 1, and it is shown secured at its upper end to the waist band 12 of the garment, at the waist seam 18.

The codpiece 30 has a channel shaped cross-section created from three fabric pieces: (shown separately in FIG. 5) a front panel 32, a left-side panel 36, and a right-side panel 38. The front panel 32 is an elongated strip of fabric having flaring ends 32*a* and 32*b*. In order to provide space in which a man's penis and scrotum may be lodged, the ends 32*a* and 32*b* of the front panel 32 are secured to the waist seam 18 and the bottom seam 20 exterior of the trunk panel 19. By selecting the proper spacing between the ends 32*a* and 32*b* of the front panel 32 shown in FIG. 5, a puffed up compartment 40 is created, such as seen in cross-section in FIG. 3. By sewing arcuate edges 36*a*, 38*a* of left side panel 36 and right side panel 38 to concave edges 36*b*, 38*b* of front panel 32, a sub-assembly is created which, in cross-section, appears as seen in FIG. 3. In other words, the three fabric parts shown in FIG. 5 may be assembled to provide a compartment 40 which is shown, in side elevation in FIG. 3, arcuate in cross-section.

A length of the front panel 32 for the man's shorts 10 is selected for a desired length of the compartment 40 to be provided. The compartment 40, as illustrated in FIG. 3, is located between the front panel 32 and the trunk panel 19. The length of the compartment 40 is chosen to allow for comfortable room for the male genitals whether flaccid or erect.

It is an additional feature of the preferred embodiment that the compartment 40 comprises a loose fitting compartment around the genitals. Such a loose fitting compartment prevents compression of the genitals against the male's lower trunk, such as occurs in shorts known to the art. By properly selecting the lengths of the front panel 32, the right-side panel 38, and the left-side panel 36 a suitably loose compartment 40 is formed. By reducing compression of the genitals against the trunk, the thermal influence of the trunk to the genitals is reduced, pressure on the genitals is reduced, and comfort to the wearer is increased.

The codpiece 30 is secured to the trunk panel 19 at the waist seam 18. Alternatively (not shown) the front panel 32 could be attached to the trunk panel 19 somewhere below the seam 18. The left-side panel 36 is secured along its length on an opposite side 41 to its arcuate edge 36*a*, to the trunk panel 19 and portions of the fabric panel 14. The right-side panel 38 is secured on a second edge 39 opposite its arcuate edge 38*a*, to the fabric panel 14 up to the seam 18. A fly welt 38*c* is sewn to the right-side panel 38 between the first lateral seam 22*a* and the leg-gripping band 16*a* to reinforce the second edge 39 of right-side panel 38. The right-side panel 38 is not secured to the trunk panel 19 between the first lateral seam 22*a* and the leg-gripping band 16*a*. Thus, an access opening 44 is formed between the right side panel 38 and the trunk panel 19. The access opening 44 is for removal of the man's penis from the codpiece 30 in order to urinate. The man's shorts 10 of the preferred embodiment have the access opening 44 adjacent to the right-side panel 38. However, the access opening 44 could just as well be located adjacent to the left side panel 36 in a "mirror image" construction of the shorts 10, and such shorts are encompassed by the present invention.

The codpiece 30, when secured to a man's underwear garment, thus provides what is necessary to receive a man's penis and scrotum after they are moved through the slot 24 formed in the trunk panel 19 of the underwear shorts.

Figure 2:
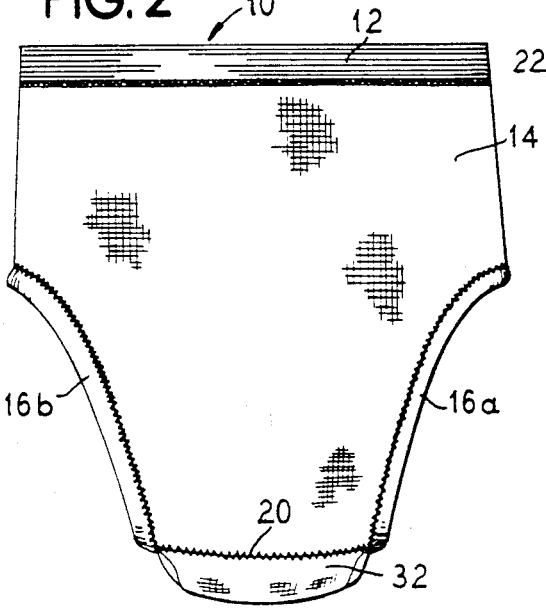
FIG. 2 is a rear elevational view of the man's shorts, illustrated in FIG. 1, but showing the man's shorts in a flattened condition, such as when ironed, or pressed, for purposes of flattened storage, or packaging prior to sale or use.

FIG. 2 shows the man's shorts 10 in a rearward view with the shorts 10 in a flattened condition. This view shows the fabric panel 14 to be a back-and-sides encircling fabric secured to the waist band 12 at the waist seam 18 and extending downwardly from the waist band 12 to attach to the two leg-gripping bands 16*a* and 16*b*. The bottom seam 20 is shown forming a juncture between the fabric panel 14 and the front panel 32 of the codpiece 30. It should be noted that the fabric panel 14 can be made of a plurality of panels adequately sewn together, depending on the size of the man's shorts.

FIG. 3 shows that the trunk panel 19 extends from the waist seam 18, which is located inwardly of waist band 12 and extends downwardly to the bottom seam 20.

Figure 4:
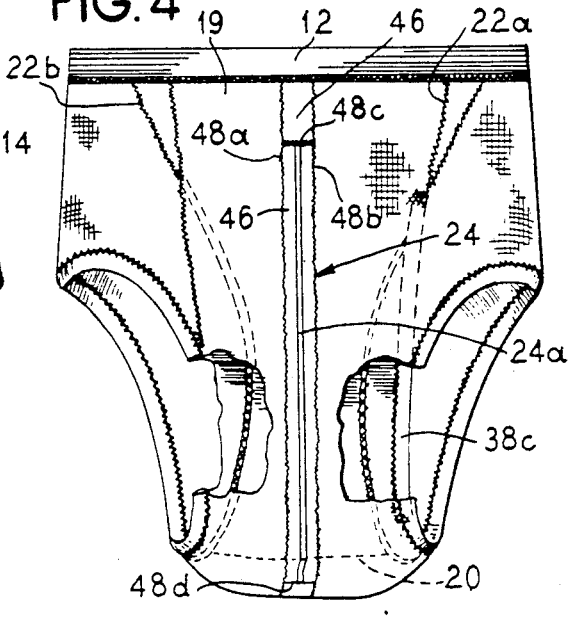
FIG. 4 is a front elevational view of the interior of the man's shorts shown in FIG. 1, such as would be seen when the garment of FIG. 1 is turned inside-out.

FIG. 4 shows an inside out view of the shorts shown in FIG. 1. In this view details of the slot 24 can be seen. The slot 24 is a reinforced opening. A rectangular fabric reinforcement 46 is secured to the trunk panel 19 at lateral slot seams 48*a*, 48*b*, and at waist seam 18 and bottom seam 20. The slot reinforcement 46 can be an extra thickness of material or sewn on welts, and the slot reinforcement can extend from the waist seam 18 to the bottom seam 20. The function of the slot reinforcement 46 is to give structural strength to the opening, to prevent fraying or ripping of the opening, and to give some structural rigidity to the slot to help retain the relative shape of the slot in a resilient fashion to closely form around the man's genitals once inserted therethrough, and to provide a structure for gripping by the wearer when manipulating the slot to put on or take off the shorts. The reinforcement 46 can also be an elastic material to help the slot closely form around the genitals. The slot 24 comprises a fly-like opening 24*a* which extends nearly the length of the slot reinforcement 46 terminating at reinforcing seams 48*c*, 48*d*, the reinforcing seams prevent ripping at opposite ends of the fly-like opening 24*a*.

Figure 5:
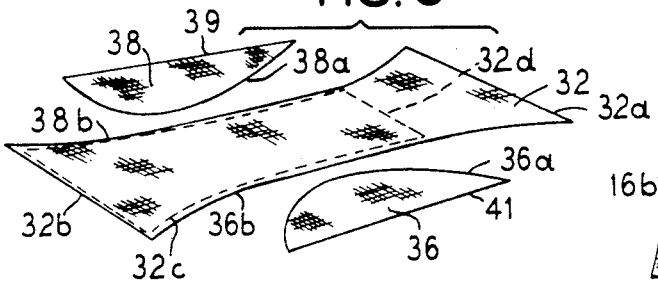
FIG. 5 is an exploded view of fabric pieces used to construct the codpiece of FIG. 1.

FIG. 5 shows the codpiece 30 in an exploded view. The front panel 32 is shown being generally rectangular but having concave edges 36*b*, 38*b* which form the flared ends 32*a* and 32*b*. The right side panel is shown comprising the arcuate edge 38*a* and the second edge 39, generally straight edge. The left side panel 36, similar to the right side panel in shape, comprises the arcuate edge 36*a* and the opposite side 41, a generally straight side. Additionally, as an added feature of the present invention a double thickness of fabric is utilized for the front panel 32 of the codpiece 30. An inside panel 32*c* as shown dashed in FIG. 5, can be sewn into the shorts 10 to provide an extra layer of absorbency, useful after urination, to absorb accidental urine. Alternatively, the inside panel 32*c* or the front panel 32 can be constructed of an extra absorbent material, different from the material of the shorts. The inside panel 32*c* can be sewn along the seams joining left-side panel 36 and right-side panel 38 to the front panel 32 and along the bottom seam 20 joining the front panel 32 to the fabric panel 14, and at attachment seam 32*d* onto the front panel 32. Alternatively, attachment seam 32*d* can be eliminated and the inside panel 32*c* made congruent with the front panel 32 and attached to the waist seam 18.

Figure 6:
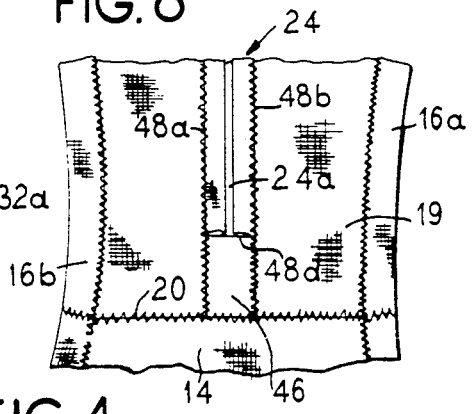
FIG. 6 is a partial cross-sectional view of the man's shorts viewed generally along line 6—6 of FIG. 3.

FIG. 6 shows details of construction near a bottom of the man's shorts 10, showing the various seams. The slot 24 is shown with reinforcing seams 48*a*, 48*b*, and 48*d*. The bottom seam 20 is shown attaching the trunk panel 19, the fabric panel 14, and the slot reinforcement 46.

FIG. 1, 4 and 6 show the fly-like opening 24*a* comprising a slit-like opening. Once the male's genitals are passed through the opening 24*a*, the reinforcing 46 and stretching of the trunk panel 19 between the leg-gripping bands 16*a*, 16*b* and the waist band 12 caused by the bulk of the man's torso, will cause the slot 24 to relatively resiliently form around the genitals adjacent to the male's torso. By so doing, the trunk panel 19 forms a layer of insulation between the male's genitals and the rest of the male's body. Additionally, the slot 24 and the trunk panel 19 help to separate and distance the males genitals from the rest of the male's body. Thus the invention helps to reduce the thermal influence of the male's trunk or torso on the reproductive organs. Although in the preferred embodiment the shape of the fly-like slot opening 24*a* is a linear slit, other shaped openings can be readily visualized. An elliptical opening, a pear-shaped opening, a rectangular opening or a round opening could just as well be utilized to pass the male's genitals from the trunk panel 19 into the codpiece 30. All shapes for the opening are encompassed by the present invention.

FIG. 1 and 2 illustrate the neat and orderly appearance of the man's shorts. A minimum of visible seams are utilized. FIG. 1 also illustrates a symmetrical appearance of the front of the man's shorts with a smooth uncluttered look, no special fly arrangement is readily noticeable.

The present invention minimizes the amount of seams required to construct the man's shorts. Thus, the fabric panel 14 the trunk panel 19 and the front panel 32 are joined together at common seams, such as the waist seam 18 and the bottom seam 20. It is understood that in connection with the construction of this garment and the illustration of such a maximum use of junction lines, where multiple parts are to be secured together by seams or stitching, is utilized to simplify and make cost efficient the construction of the garment. Varying the location or complexity of seams is within the spirit of the present invention. It is further understood that the man's shorts depicted in a preferred embodiment would be fabricated of cotton-like materials. However, all fabrics which are appropriate for such man's shorts or garments are encompassed by the present invention, including man-made fiber fabrics.

While one particular embodiment of this invention has been disclosed herein, and is shown and described, it will be obvious to those skilled in the art, that various changes and modifications may be made therein without departing from the spirit and scope of the invention and, therefore, it is intended in the appended claims to cover all such changes and modifications which fall within the true spirit and scope of the invention.

Although other modifications and changes may be suggested by those skilled in the art, it is the intention of the inventors to embody within the patent warranted hereon all changes and modifications as reasonably and properly come within the scope of their contribution to the art.

We claim as our invention:

1. In a man's underwear shorts having a torso encircling waistband, a pair of spaced apart leg-engaging fabric sleeves arranged below said waistband, and a trunk encircling fabric panel connecting said waistband and said leg-engaging fabric sleeves, said fabric panel providing a genital egress opening on a front side, and a codpiece pouch covering said opening, attached to said fabric panel on an outward facing side of said fabric panel, the improvement comprising:

said codpiece pouch fashioned attached at a first end to said waistband and extending downwardly, loosely spanning the height of said fabric panel, and attached at a second end to said fabric panel at a seam located at a backside of said fabric panel, said codpiece pouch having a frontal fabric length substantially greater than the distance between the waistband and the seam along said fabric panel, said codpiece pouch thus forming an enclosed volume with said fabric panel, a portion of said closed volume overlying a downward facing surface of said fabric panel; and said opening is fashioned as a slot extending from nearto said waistband to a lowest point of said fabric panel between said leg-engaging sleeves, said seam located rearwardly of said lowest point on said fabric panel.

2. The improvement of claim 1 further comprising:

said codpiece pouch being secured along a first side to said fabric panel and partially secured along a second side of said fabric panel, said second side left partially unsecured to form a fly.

3. The improvement of claim 1 further comprising:

said codpiece pouch being fashioned with a front panel with flared ends, having arcuate edges, the front panel thus forming a tapered frontal area along the length of said front panel with a minimum width located along said length of said front panel at a position on the front side of said fabric panel; and two side panels each having a straight edge and an outwardly curving edge, each straight side abutting said fabric panel and each curved side secured along one arcuate edge of said front panel.

4. The improvement of claim 1, wherein said opening comprises a reinforced slot.

5. The improvement of claim 1, wherein said opening comprises an elastically resilient opening.

6. The improvement of claim 3, wherein said straight edge of one of said side panels is arranged partially unsecured to said fabric panel providing a fly opening, and providing a reinforcing welt along said straight edge along said fly opening.

7. The improvement of claim 3, wherein said fabric panel comprises:

a wrap-around panel secured to said waistband and to said leg engaging sleeves and forming a back and sides of said shorts;

a trunk panel secured to said wrap around panel at two free side ends of said wrap-around panel and secured to said waistband, and secured to said wrap-around panel at a bottom end of said wrap-around panel, at said seam, said trunk panel providing said opening overlain by said codpiece pouch; and one of said flared ends of said front panel is secured to said trunk panel at said waistband, and said respective other flared end of said front panel is secured to said trunk panel at said seam.

8. The improvement of claim 3, wherein said shorts are composed of cotton.

9. The improvement of claim 3, wherein said shorts are composed of a man made fiber fabric.

10. The improvement of claim 3, wherein said front panel further comprises an inside panel means for increasing absorbing ability of the codpiece panel means.

11. The improvement of claim 3, wherein said arcuate edges of said front panel have a selected curvature to limit the front lateral profile of said pouch between said leg-engaging fabric sleeves.

12. In a man's underwear shorts having a torso encircling waistband, a pair of spaced apart leg-engaging fabric sleeves arranged below said waistband, and a trunk encircling fabric panel connecting said waistband and said leg-engaging fabric sleeves, said fabric panel providing a genital egress opening on a front side, and a codpiece pouch covering said opening, attached to said fabric panel on an outward facing side of said fabric panel, the improvement comprising:

said codpiece pouch fashioned attached at a first end to a high seam on said fabric panel and extending downwardly, and attached at a second end to said fabric panel at a low seam, said codpiece pouch having a frontal fabric length substantially greater than the distance between the high seam and the low seam along said fabric panel, for forming an enclosed volume with said fabric panel, said enclosed volume sized to receive in a loose fitting manner a man's genitals passed through said opening when said man wears said shorts; and said codpiece pouch being fashioned with a front panel with flared ends, having arcuate edges, the front panel thus forming a tapered frontal area along the length of said front panel with a minimum width located along said length of said front panel at a position on the front side of said fabric panel; and two side panels each having a straight edge and an outwardly curving edge, each straight side abutting said fabric panel and each curved side secured along one arcuate edge of said front panel.

13. The improvement of claim 12, wherein said codpiece pouch comprises an access fly on one side, exterior of said fabric panel and communicating exterior of said codpiece pouch, for the wearer to selectively position his penis therethrough.

14. The improvement of claim 12, wherein said fabric panel comprises:

a wrap-around panel forming a back and sides of said shorts;

a trunk panel secured to said wrap-around panel at two free side ends of said wrap-around panel, and secured to said wrap-around panel at a bottom end of said wrap-around panel at a backside of said shorts at said seam, said trunk panel providing said opening for communicating with said codpiece compartment;

and said waistband is secured to said wrap-around panel and to said trunk panel;

said two leg engaging sleeves secured to said wrap-around panel and to said trunk panel;

said codpiece pouch secured at a top end to said trunk panel near a top of said trunk panel, and secured at a bottom end to said trunk panel at said seam, said codpiece compartment secured on one straight side to said trunk panel, and left partially unsecured on an opposite straight side, forming an access fly.

15. The improvement of claim 14, wherein said partially unsecured straight side of said codpiece pouch compartment comprises a reinforcing welt.

16. The improvement of claim 12, wherein said front panel comprises a fabric of double thickness to increase absorbency.

17. The improvement of claim 12, wherein said opening is a slot reinforced around its periphery by a layer of fabric.

18. The improvement of claim 12, wherein said shorts are composed of a cotton-like material.

19. The improvement of claim 12, wherein said genital egress opening is arranged through said fabric panel beginning near to said waistband, extending substantially above the male's penis and scrotum when worn, and terminating at a bottom of said fabric panel.

* * * * *